US011156049B2

(12) United States Patent
Telfer et al.

(10) Patent No.: US 11,156,049 B2
(45) Date of Patent: Oct. 26, 2021

(54) WELL ABANDONMENT

(71) Applicant: Ardyne Holdings Limited, Aberdeen (GB)

(72) Inventors: George Telfer, Aberdeen (GB); Michael Wardley, Aberdeen (GB); James Linklater, Aberdeen (GB); Wojciech Buczak, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 16/650,450

(22) PCT Filed: Sep. 28, 2018

(86) PCT No.: PCT/GB2018/052767
§ 371 (c)(1),
(2) Date: Mar. 25, 2020

(87) PCT Pub. No.: WO2019/069054
PCT Pub. Date: Apr. 11, 2019

(65) Prior Publication Data

US 2020/0232295 A1 Jul. 23, 2020

(30) Foreign Application Priority Data

Oct. 3, 2017 (GB) ..... 1716096
Jul. 10, 2018 (GB) ..... 1811289

(51) Int. Cl.
*E21B 29/00* (2006.01)
*E21B 10/32* (2006.01)
(Continued)

(52) U.S. Cl.
CPC ..... *E21B 29/005* (2013.01); *E21B 10/322* (2013.01); *E21B 17/07* (2013.01); *E21B 33/13* (2013.01)

(58) Field of Classification Search
CPC ..... E21B 29/002; E21B 29/02; E21B 29/005
See application file for complete search history.

(56) References Cited

U.S. PATENT DOCUMENTS 3,224,507 A 12/1965 Cordary et al.
5,074,355 A 12/1991 Lennon
(Continued)

FOREIGN PATENT DOCUMENTS

EP 1076758 B1 6/2004
EP 3085882 A1 10/2016
WO WO 99/57409 11/1999

OTHER PUBLICATIONS

European Patent Office as Int'l Search Authority, International Search Report and Written Opinion for PCT/GB2018/052767; dated Jan. 17, 2019; all pages; European Patent Office, Rijswijk, The Netherlands.

(Continued)

*Primary Examiner* — David Carroll
(74) *Attorney, Agent, or Firm* — Law Office of Jesse D. Lambert, LLC

(57) ABSTRACT

Method and apparatus for removing a section of well tubing. The well tubing (24) is milled in an upward direction on a hydraulic tensioning device (14) which maintains a constant load on the section mill so that long sections of tubing can be removed in a near continuous procedure on a single trip into the well. The hydraulic device includes an indicator (30) to provide a signal as the device nears each end of a stroke to inform a user that: the section mill is about to bottom out and the work string needs to be raised to extend the device; and the device is fully extended and can begin another stroke. Embodiments are described for use in a rigless well abandonment procedure.

18 Claims, 5 Drawing Sheets

(51) Int. Cl.
*E21B 17/07* (2006.01)
*E21B 33/13* (2006.01)

(56) References Cited

U.S. PATENT DOCUMENTS

| | | | | |
|---|---|---|---|---|
| 5,253,714 | A * | 10/1993 | Davis | E21B 10/322 166/376 |
| 6,679,328 | B2 | 1/2004 | Davis et al. | |
| 2002/0162659 | A1* | 11/2002 | Davis | E21B 29/005 166/298 |
| 2011/0297379 | A1 | 12/2011 | Laird et al. | |
| 2012/0292028 | A1 | 11/2012 | Crow et al. | |
| 2013/0284458 | A1 | 10/2013 | Dancer et al. | |
| 2014/0034317 | A1 | 2/2014 | Hekelaar | |
| 2015/0275605 | A1* | 10/2015 | Bennett | E21B 33/134 166/298 |
| 2018/0094503 | A1* | 4/2018 | Wardley | E21B 29/002 |

OTHER PUBLICATIONS

Intellectual Property Office of the UK Patent Office, Combined Search and Examination Report for GB1716096.1; dated Nov. 17, 2017; all pages; Intellectual Property Office, Newport, South Wales.
Uropean Patent Office as Int'l Search Authority, International Search Report and Written Opinion for PCT/GB2018/052768; dated Jan. 28, 2019; all pages; European Patent Office, Rijswijk, The Netherlands.
Ntellectual Property Office of the UK Patent Office, Combined Search and Examination Report for GB1815831.1; dated Mar. 13, 2019; all pages; Intellectual Property Office, Newport, South Wales.

* cited by examiner

WELL ABANDONMENT

The present invention relates to methods and apparatus for well abandonment and in particular, though not exclusively, to an apparatus and method for removing a portion of a tubular across a longitudinal section of the well to enable the placement of a cement plug.

When a well has reached the end of its commercial life, the well is abandoned according to strict regulations in order to prevent fluids escaping from the well on a permanent basis. In meeting the regulations it has become good practise to create the cement plug over a predetermined length of the well. As a well is constructed by locating conduits such as casing, lining, pipe and tubing (herein collectively referred to as tubulars) into the well, the cement plug must extend over all annuli present in the well. In many cases all conduits are removed leaving the outer casing, including the annulus bounded by the formation.

The integrity of the casing and in particular, the cement in an annulus will determine if a cement plug can just be located in the tubular. Steel casing can leak at the connections or corrode from acids. Cement can deteriorate with time too, but leaks also happen when cement shrinks, develops cracks or channels, or is lost into the surrounding rock when applied. If integrity fails, gases and liquids can leak out of the casing or, just as importantly, move into, up, and out of the well through faulty cement between the casing and the rock wall. These issues affect the ability to plug a well for abandonment but also for ensuring zonal isolation in unconventional reservoirs. Cement bond logging (CBL) can be used to log the quality of the cement bond but if the CBL shows the bond to be poor intervention is required with access needed to the outermost tubular.

One method of creating or repairing the cement plug is to mill away the inner tubular to expose the annulus behind the tubular and then pump cement into the enlarged area to create the cement plug. This is achieved using a rotatable section mill run on a work string and typically operated downwardly to remove the tubular section. In milling downwardly, the weight of the work string is used to apply downward force to the section mill to cause it to progress through the tubular being milled. This application of force to the mill by weight applied from above creates a wobble in the milling work string, which has a tendency to fracture the cutting inserts on the section mill blades. This, in turn, causes the mill to wear out sooner, resulting in the removal of less tubular footage before replacement of the mill is required. Further, since milling progresses downwardly, cuttings must be removed from the well bore as they are formed, to avoid forming a ball of cuttings around the mill and reducing its effectiveness. Specialized formulation of milling fluid, and maintenance of proper fluid flow rates, are required in order to circulate the cuttings out of the hole.

To overcome these disadvantages an alternative method has been developed which perforates the tubular and pumps cement through the perforations to travel up the annulus and thereby create a plug within the annulus. This 'perf and plug' arrangement, sometimes referred to as cement squeeze, has disadvantages in that by forcing the cement through narrow apertures there is no guarantee that the cement fully contacts the surrounding formation as the cement may not reach all areas in the annulus. As a result, the cement plug may be compromised and rendered at least partially ineffective. This method does provide a major advantage in that it can be performed from a floating vessel to offer what is referred to as a 'rigless' method of abandonment. By removing the requirement for a drilling rig, significant time and therefore costs can be made in the well abandonment procedure. In a rigless method the work string is anchored to the tubular and as such sea swell will place tension and/or weight on the work string. Even with the use of heave compensators, this variable load means that a section mill, reliant on using controlled weight to operate, cannot be used.

U.S. Pat. No. 6,679,328 discloses a method and apparatus for milling a section of casing in an upward direction, utilizing a downhole hydraulic thrusting mechanism for pulling a section mill upwardly. A downhole motor and torque anchor can be used to rotate the section mill, or the mill can be rotated by a work string. A stabilizer above the section mill can be used to stabilize the mill relative to the casing being milled. A spiral auger below the section mill can be used to move the cuttings downwardly.

In U.S. Pat. No. 6,679,328 the method of operation first sets the anti-torque anchor against the innermost casing as the milling fluid pressure is increased, which also starts the mud motor running and exerts an upward force on the section mill with the up-thruster. Fluid pressure extends the arms and blades of the mill, and the mill is rotated by the downhole motor. The section mill can be set to extend its arms at a relatively low pressure, so that the arms will extend before the up-thruster begins to lift the arms into cutting contact with the casing. Additionally, the motor can be designed to bypass fluid before it begins to rotate. The cutter arms extend, then the torque anchor blades contact the casing wall, then the mud motor begins to rotate, and finally, the up-thruster begins to lift the section mill. On the first cut, the casing is cut through, and then a portion of the 7" casing is milled out, until the up-thruster reaches its full travel, or "bottoms out". This opens piston valves, and a pressure drop will be noted in the milling fluid at this time. Then, the milling fluid pressure is reduced, to stop rotation of the mud motor, release the anti-torque tool, retract the mill arms, and allow the up-thruster to extend to its original length. The work string is then lifted to raise the section mill until its arms are positioned next to the milled lower end of the casing, at the top of the milled window. Pressure is then increased to extend the mill arms, reset the anti-torque anchor, rotate the mud motor, apply upward pressure to the mill, and resume milling. This process is then repeated as required. In this way, a window of desired length, for example, 250 feet, is cut out of the casing. The advantages of this arrangement are in the reduced wear to the blades due to constant tension applied and automatic removal of cuttings as they fall into the well.

A disadvantage of this method is that the mill arms are retracted every time the upthruster needs to be extended to its original length. The stopping and starting of milling produces the most wear on the mill and thus in this disclosure the apparatus must still be removed from the well regularly to replace the cutting blades. A further disadvantage is that the upthruster extends to its original length before the work string is lifted to raise the section mill. In this way the section mill must be re positioned at the bottom of the cut section of casing. The distance that the section mill requires to be raised is determined at surface which is difficult to judge. This is particularly difficult when the well is a horizontal well and the work string may be lying on the low side. In these circumstances raising the work string may only vertically lift the section mill across the diameter of the borehole rather than pull the string through the casing and thus raising the work string at surface will not reposition the section mill further up the wellbore at the bottom of the casing.

It is therefore an object of the present invention to provide a method of removing a section of well tubing which obviates or mitigates at least some of the disadvantages of the prior art.

It is a further object of the present invention to provide apparatus for removing a section of well tubing which obviates or mitigates at least some of the disadvantages of the prior art.

According to a first aspect of the present invention there is provided a method for removing a section of well tubing comprising the steps:

a) providing a work string with a hydraulic tensioning device and a section mill mounted below the hydraulic tensioning device;
b) lowering the work string into tubing to be milled;
c) pumping fluid through the work string to actuate the section mill and extend cutter blades;
d) rotating the section mill to mill the tubing with the cutter blades;
e) pumping fluid through the work string to actuate the hydraulic tensioning device to hydraulically pull a lower end of the hydraulic tensioning device upwards towards the work string thereby pulling the section mill upwards while milling the tubing;
f) raising the work string to extend the hydraulic tensioning device while milling the tubing;
g) repeating steps (e) and (f) to remove a longitudinal section of the tubing.

In this way, a substantially or near constant load is applied to the section mill and there is no requirement to reposition the section mill on each stroke of the hydraulic tensioning device. This makes the invention available for use in a rigless method.

Preferably, step (f) is performed before the hydraulic tensioning device bottoms out. When the hydraulic tensioning device 'bottoms out' which occurs when the portion of the device being raised towards the work string completes a stroke and can move no further, the load applied to the section mill is unpredictable. Thus in the present invention the work string is raised to extend the hydraulic tensioning device before this occurs. In this way, the mill is operated in a near continuous operation which saves wear on the cutter blades.

Preferably the method includes cycling through steps (e) to (f) repeatedly until a desired length of tubing has been removed.

As the wear on the cutter blades is reduced desired lengths of tubing such as 100-200 feet can be removed in a single trip.

Preferably, the method includes performing steps (e) and (f) together so that the work string is raised gradually to keep the device in a mid-stroke position so that a constant load is applied to the mill and continuous milling is achieved over a desired length of tubing.

Preferably a first signal is provided when the hydraulic tensioning device is near the end of its stroke before bottoming out so that the work string can be raised. In this way, a user is notified at surface to raise the work string before bottoming out occurs so as to maintain a constant tension on the section mill. The first signal may be a pressure change in the fluid at surface.

Preferably a second signal is provided when the hydraulic tensioning device is fully extended. In this way, a user is notified that they have raised the work string by a sufficient distance and excess load is not placed on the section mill. The second signal may be a pressure change in the fluid at surface.

Advantageously, the work string is lowered from a floating vessel. In this way, a section of tubing can be removed in a rigless arrangement.

Preferably the method includes the step of rotating the work string to rotate the section mill. Alternatively the method may include the step of actuating a downhole motor to rotate the section mill.

The method may include the step of cutting through the tubing prior to milling the tubing. In this way the tubing can be cut and milled on a single trip. Advantageously, the cut can be made by the cutter blades which are also used to mill the tubing.

The method may include the step of disposing of cuttings downhole. In this way, cuttings do not have to be circulated to surface and disposed of.

The method may include the step of inserting a seal in the well tubing at a location below the section of well tubing to be removed. The seal may be a bridge plug, a cement plug or a packer. The method may include the further step of conducting a cement bond log (CBL) over the length of well in which the section of well tubing has been removed. This would allow a test on cement bond integrity behind an outer tubular in the well. The method may further include cementing over the length of well in which the section of well tubing has been removed.

According to a second aspect of the present invention there is provided apparatus for removing a section of well tubing comprising:

a work string;

a hydraulic tensioning device having an upper end and a lower end, the upper end being attachable to the work string, the hydraulic tensioning device being adapted to stroke and selectively pull the lower end upwardly towards the work string;

a section mill attachable to a lower end of the hydraulic tensioning device, the section mill including a plurality of blades, the blades being arranged to move from a first position within the section mill to a second position being extended to contact the well tubing and thereby mill the tubing in an upward direction;

characterised in that:

the hydraulic tensioning device includes at least one indicator, the at least one indicator providing a first signal and a second signal when the hydraulic tensioning device is towards each end of its stroke, respectively.

In this way, the user at surface knows when the hydraulic tensioning device is fully extended and can stop raising the work string and is notified as the stroke is ending and can raise the work string to prevent the device bottoming out. Thus by raising the work string gradually, ideally the user keeps the device in a mid stroke position so that a constant tension is applied to the mill without obtaining either signal.

Preferably the work string has a through bore for the passage of fluid from surface to extend the cutter blades and stroke the hydraulic tensioning device upwards. In this way, the apparatus can be operated from surface. More preferably, the indicator comprises a variable fluid flow restrictor. In this way, variations in the pressure of fluid can be used as the first and second signals. Alternatively, the indicator may comprise an electronic switch which detects the position of relative parts of the hydraulic tensioning device. In this way, an electronic signal can be generated for the first and second signal. Those skilled in the art will appreciate that such electronic signals can be transmitted to surface using telemetry.

The apparatus may include a downhole motor. In this way, the section mill can be rotated downhole instead of via rotation of the work string. The work string may be threaded pipe, being right or left-handed. Alternatively the work string may be coiled tubing. In this way, the section mill can be arranged to be left-hand turned so as to prevent to unthreading of sections of the pipe being milled. The apparatus may include an anchor to prevent rotation of the work string. In this way, the work string above the motor is prevented from winding. The anchor may be an anti-torque anchor which includes friction elements to prevent undesired rotation of the work string.

A spiral auger may be located below the section mill to assist in moving cutting downhole. In this way, cuttings do not have to be circulated to surface and disposed of.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Additionally the terms "above", "below", "upper" and "lower" are relative and take their standard meaning when considering a standard vertical will with "lower" being upstream and "upper" being downstream in the well.

There will now be described, by way of example only, various embodiments of the invention with reference to the drawings, of which:

Figures 1A, 1B, 1C, 1D:
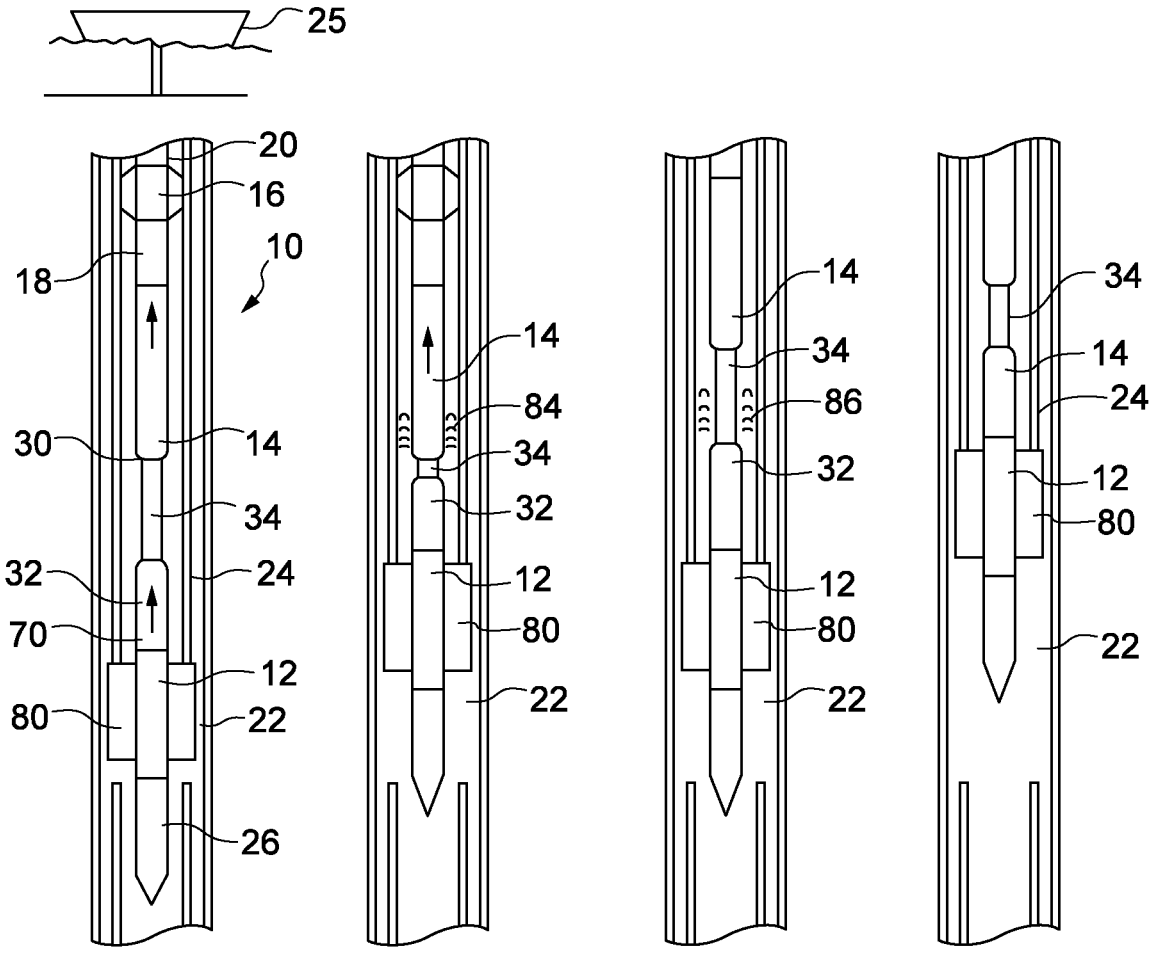
FIGS. 1A to 1D are schematic illustrations of apparatus for removing a section of well tubing carrying out a method for removing a section of well tubing according to an embodiment of the present invention.

Referring initially to FIG. 1A of the drawings there is illustrated apparatus, generally indicated by reference numeral 10, having a section mill 12 and a hydraulic tensioning device 14 for removing a section of well tubing. The hydraulic tensioning device 14 includes an indicator 30 providing a first signal and a second signal when the hydraulic tensioning device is towards each end of its stroke, respectively, according to an embodiment of the present invention.

Like the arrangement of U.S. Pat. No. 6,679,328, incorporated herein by reference, the section mill 12 is designed for upward milling, in combination with an up-thruster tool, the hydraulic tensioning device 14, an anti-torque anchoring tool 16, and a downhole motor 18, which are mounted to a work string 20. In the present invention, the work string 20 is coiled tubing. The apparatus 10 is tripped into the hole to position the section mill 12 at the lower end of the interval where a section 22 or window is to be cut. For clarity, FIG. 1A actually shows the apparatus 10 after the inner tubular 24 has been cut through, and after the milling of the section 22 has begun. The section mill 12 is at the bottom of the apparatus 10, with the hydraulic tensioning device 14, a mud motor 18, and anti-torque anchoring tool 16 positioned above that, in order. A spiral auger 26 can be positioned below the section mill 12, to assist in moving the cuttings downhole.

The hydraulic tensioning device 14 may be considered as a load control sub or a pressure balanced weight transfer sub. The purpose of the hydraulic tensioning device 14 is to supply a constant upward load on the section mill 12. When operated from a floating vessel 25 in a rigless arrangement, upward milling would be impossible unless the constant load can be maintained on the mill as an operator would be unable to raise the work string to provide a constant load in the presence of heave from the floating vessel 25.

Figure 2A:
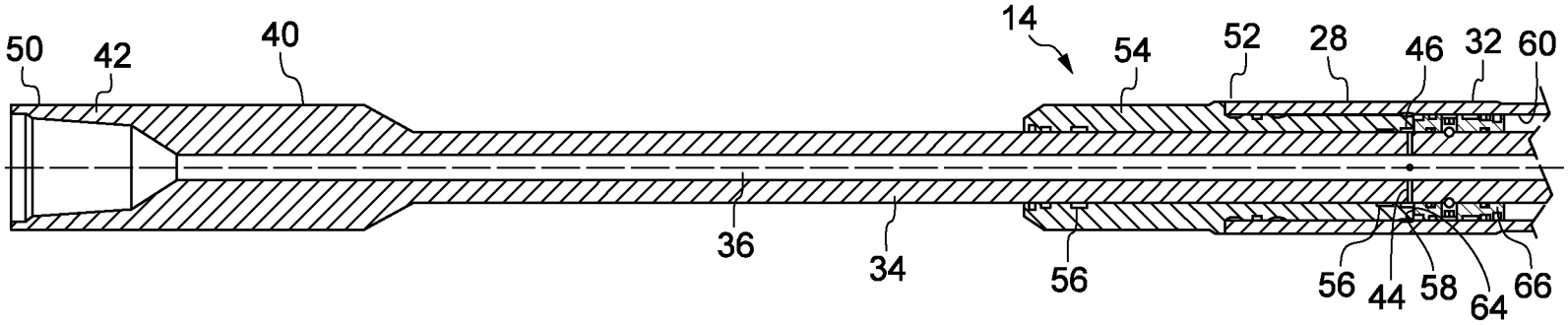
FIGS. 2A to 2C are a cross-sectional view of a hydraulic tensioning device in an extended configuration according to an embodiment of the present invention.
Figure 2B:
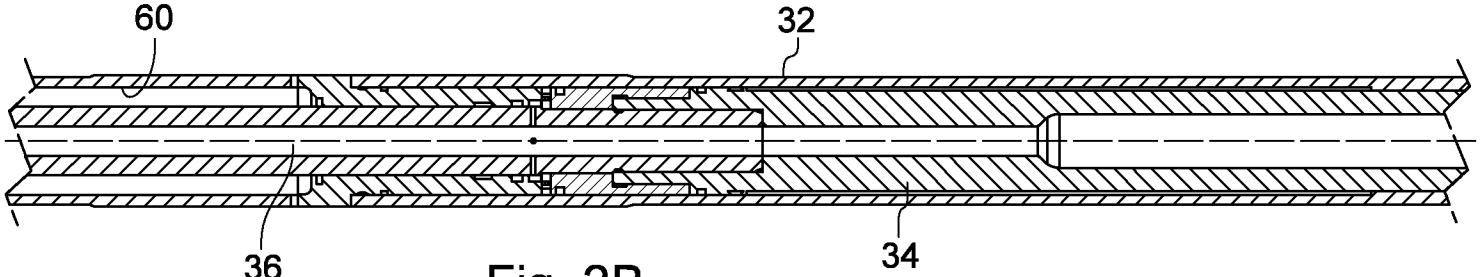
Figure 2C:
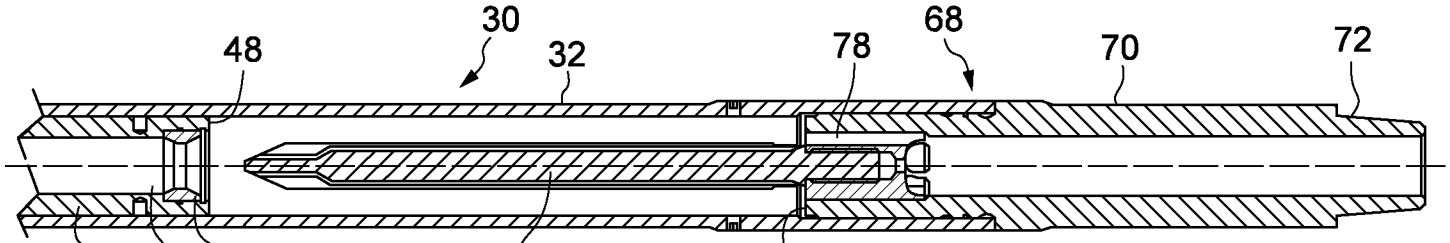

Referring now to FIGS. 2A-C there is illustrated a hydraulic tensioning device 14. In principle the hydraulic tensioning device 14 comprises a substantially cylindrical body 28 having an outer mandrel 32 which slides over an inner mandrel 34. Fluid pumped through a central bore 36 meets a restriction, choke or nozzle 38 which causes a back pressure in the bore 36. The fluid is then forced between the mandrels 32,34 and with one mandrel 34 held in position relative to the work string 20, the other mandrel 32 will move relative to the fixed mandrel 34. As long as fluid is pumped at a constant rate the back pressure will be constant and the movement of the mandrel 32 will be constant thereby imparting a constant load or tension upon anything connected to it.

Inner mandrel 34 is part of a top sub 40 which includes a standard box section 42 for attachment of the hydraulic tensioning device 14 to the work string 20. The inner mandrel 34 contains the ports 44 through the body of the mandrel 34 to access a chamber 46 between the mandrels 32,34. The inner mandrel 34 has the nozzle 38 located within the central bore 36 attached at a lower end 48. The box section 42 at the upper end 50 of the top sub 40 has a first diameter with the inner mandrel 34 having a smaller diameter than the first diameter.

Arranged over the inner mandrel 34 is the outer mandrel 32. At an upper end 52 of the outer mandrel 32 there is a locking sub 54. This provides sliding seals 56 between the mandrels 32,34 and a wall 58 of the chamber 46. The chamber 46 is otherwise formed by inner wall 60 of the outer mandrel 32, the outer wall 62 of the inner mandrel 34 and a wall 64 of a piston 66 fixed to the wall 62 of the inner mandrel 34. The ports 44 are arranged to access the chamber 46 beside the wall 64 of the piston 66. The distance between the piston 66 and the box section 42 determines the stroke length for the hydraulic tensioning device. This distance may be set to one to two metres. However it may be set to shorter lengths if desired.

At a lower end 68 of the outer mandrel 32 there is a bottom sub 70 including a standard pin connection 72 for attachment to another tool such as the section mill 12. The outer diameter of the outer mandrel 32 and pin section 72 matches the outer diameter of the box section 42 of the top sub 40 to ensure there are no parts to catch in the well bore. Mounted on the upper end 74 of the bottom sub 70 is a prong 76. Prong 76 forms the indicator, generally indicated by reference numeral 30, used to provide the first and second signals to indicate the position of the outer mandrel 32 relative to the inner mandrel 34 in relation to the stroke distance. The prong 76 lies on the central axis of the bore 36 within the outer mandrel 32 and is sized to locate within and slide through the nozzle 38. Through ports 78 are arranged through the bottom sub 70 to provide a fluid pathway through the central bore 36 around the prong 76.

The inner wall 60 of the outer mandrel 32 and the outer wall 62 of the inner mandrel 34 will have splined sections, typically around the nozzle 38, so that rotation of the top sub 40 via the work string 20 and, if present a downhole motor 18, is transmitted through the entire hydraulic tensioning device 14 to the section mill 12 located on the bottom sub 70.

Returning now to FIGS. 1A, the hydraulic tensioning device 14 is shown in its fully extended position matching the arrangement illustrated in FIGS. 2A-C. The section mill 12 is attached to the bottom sub 70.

The section mill 12 may be as shown in U.S. Pat. No. 6,679,328 having a plurality of arms each pivoted around a point, mounted in longitudinal slots, which are held in the open position by an upward moving wedge block moved by a piston to support the arms and prevent them from collapsing under heavy loading. Actuation of the section mill 12 is achieved by pumping fluid through the work string 20 which acts on the piston. Release of hydraulic pressure will allow the arms to retract back into the body of the mill 12. The section mill arm can be fitted with a casing cutter type blade for penetration of the tubing, or the arm can be fitted with the square type blades typically found on a pilot mill, to provide for milling an extended length of tubing. In this embodiment, the section mill 12 can first be operated to penetrate the tubing with the casing cutter type blade, then the arms can be exchanged for arms having the pilot mill type blades, for the remainder of the procedure.

An alternative section mill 12 is described in Applicants co-pending patent application GB1713525.2, incorporated herein by reference. This section mill 12 includes elongate blades 80 which have a cutting structure extending along at least a portion of a length from a first edge and at least a portion of a width from a second edge of the elongate cutter blade, the second edge being longer than the first edge, the first and second edges being perpendicular to each other. The blades are moved axially and radially relative to the tubular body to arrange the second edge parallel to the central longitudinal axis for milling. As the blades are moved out the apex, where the first edge meets the second edge, acts as a cutter and will cut the tubing thereby opening up a window in the tubing as the blades are extended. Consequently this means that the initial cutting and subsequent milling of the tubing does not require a change of blades and the elongate blades allow an entire section of tubing in excess of 200 feet to be removed on a single trip in the well. This section mill can also be operated by fluid pressure acting on a piston and is thus operable from surface.

Also shown in FIG. 1A is an anti-torque anchor 16 and a downhole motor 18. The motor must be present when the work string 20 is coiled tubing or threaded pipe, typically drill pipe, having the standard right-hand thread. A motor may be optionally used with a left-hand threaded pipe work string. In this embodiment the downhole motor 18 is typically a mud motor as is known in the art. It will drive the string below in a left-hand turn. This is needed as the section mill 14 should preferably be left-hand turned so as to prevent the unthreading of sections of the inner tubular 24 when being milled. Consequently an anti-torque anchor 16 is required above the motor 18 to prevent the coiled tubing from winding as the section mill 14 presents a fixed point against the tubular 24. The anti-torque anchor 16 typically comprises rollers and friction blocks to allow the work string to turn in a right-hand direction when the string 20 is run in but discourage left-hand turning when the motor 18 is operated.

In use, the apparatus 10 is run into the inner tubular 24, in the arrangement shown in FIG. 1A. The hydraulic tensioning device 14 is in the fully extended configuration as illustrated in FIGS. 2A-C. With the section mill 12 positioned at a lower end of the section 22 to be cut, fluid is pumped down the central bore 36 of the work string 20, to actuate the section mill 12. The section mill 12 will rotate either through the work string alone or via the motor 18, if present. Blades 80 will initially radially extend to cut through the tubular 24 and then the blades 80 will move to the longitudinal position shown. The long side of the blade will mill the tubular 24 as the blades are extended. In the preferred embodiment of section mill 12, the blades 80 will lock in the extended position so that variations in fluid pressure through the mill 14 will not affect the milling operation.

Pumping fluid through the central bore 36 will also operate the hydraulic tensioning device 14. A back pressure will occur as fluid is pumped through the nozzle 38. This will result in fluid entering the ports 44 to fill the chamber 46. As the piston 66 is fixed in position on the inner mandrel 34 which in turn is fixed to the work string, the chamber 46 will expand by fluid pressure against the wall 58 of the locking sub 54. The locking sub 54 will therefore be forced upwards relative to the inner mandrel 34, taking the outer mandrel 32 with it. As the section mill 12 is connected to the outer mandrel 32 via the bottom sub 70, it will be raised relative to the work string 20 at a rate equal to the rate fluid enters the chamber 46. If the pump rate of fluid at surface through the central bore 36 is held constant then a constant load is applied to the section mill 12. This provides for even milling of the tubular 24 in the upward direction. It will be realised that a truly constant load cannot be achieved due to friction in the system and we may therefore consider the load to be substantially or near constant.

The work string 20 can be raised during filling of the chamber 46. This will have the effect of moving the piston 66 upwards and keep the chamber 46 from entirely filling. If the rate of raising the work string 20 is balanced against the pump rate of fluid filling the chamber 46 then a constant load or tension is applied to the section mill 12 and any length of section 22 can be milled continuously. However, it will be apparent that keeping this balance will be difficult.

If the outer mandrel 32 is raised faster than the work string 20, then the locking sub 54 risks hitting the box section 42 of the top sub 40. This will mean that the hydraulic tensioning device 14 has fully stroked and 'bottoming out' has occurred. At this point the load on the section mill 12 is unpredictable as it is entirely dependent on the load on the work string 20. When operated from a floating vessel 25 this would be undesirable as chattering could occur between the blades 80 and the tubular 24 causing potential damage to the section mill 12. In the present invention, a user is warned that the device 14 is near the end of the stroke so remedial action can be taken before bottoming out occurs.

Figure 3A:
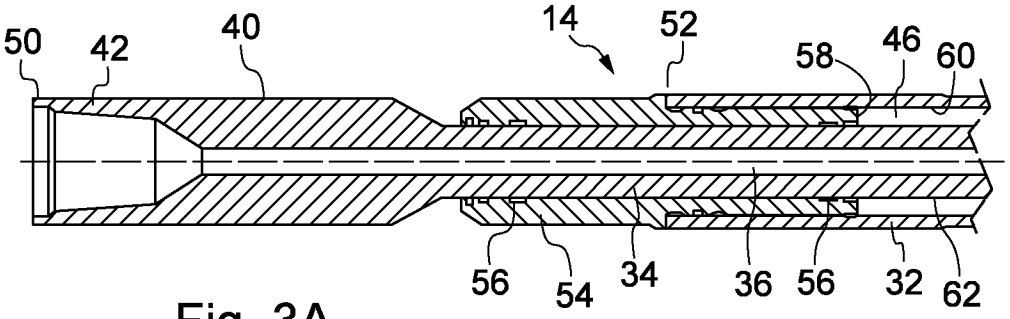
FIGS. 3A to 3C are a cross-sectional view of the hydraulic tensioning device of FIGS. 2A-C in at the end of a stroke.
Figure 3B:
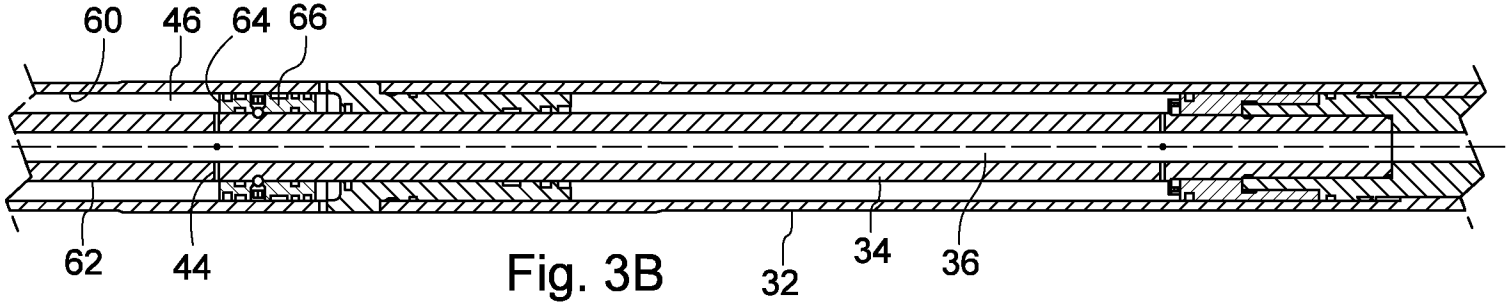
Figure 3C:
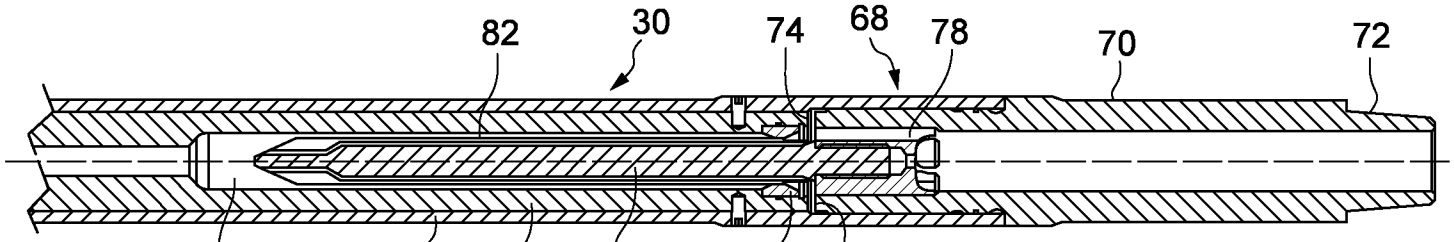

Referring now to FIGS. 3A-C, there is shown the hydraulic tensioning device 14 near the end of the stroke. In this arrangement prong 76 has travelled through nozzle 38. Channels 82 on the sides of the prong 76 allow fluid to still pass through the device as this occurs and the chamber 46 is filled. As the lower end 48 of the inner mandrel 34 reaches the upper end 74 of the bottom sub 70, fluid flow will be restricted between the nozzle 38, prong 76 and the through ports 78. This restriction will cause a drop in pressure to the fluid in the apparatus 10. The drop in pressure is noted at surface and is a first signal 84 that the device 14 is near the end of the stroke and will shortly bottom out. A user has time to react and raise the work string 20 to extend the device 14 and prevent bottoming out.

It is noted that milling of the tubular 24 is continued throughout this operation. In this way, the blades 80 are never stopped and thus overwear of the blades is prevented. This position of approaching the end of the stroke is illustrated in FIG. 1B.

When the string 20 is raised at a faster rate than the rate of fill of the chamber 46, the chamber 46 will reduce in volume as the piston 66 is brought up to meet the wall 58 of the locking sub 54. As this occurs the device 14 is stroked outwardly into its extended position again, FIGS. 2A-C. In this regard the prong 76 travels back through the nozzle and as it is released from the nozzle 38, there will be a pressure decrease in the fluid in the device 14. This will be seen at surface as a second signal 86 and is illustrated in FIG. 1C. As before, the mill 12 is continuously operating during this operation.

The pressure (from the nozzle 38) and the size of the piston 66 are chosen along with an appropriate flow rate to give the correct force on the mill to get efficient rate of cutting but without damaging the cutting structure or else creating too much cuttings which could block the hole and cause the mill to get stuck in the ground.

Thus the process can be performed as:

1. Position apparatus below bottom of tubing.
2. Start pumps at surface:
   a. Device 14 will stroke upwards and blades 80 will go out in mill 12;
   b. Monitor pressure;
   c. Note space out should have blades 80 below level of bottom of tubing even after they have stroked upwards.
3. Start rotation (note this could be achieved by a downhole motor so would start rotating when you start pumping).
4. Pick up slowly at surface until you see a pressure increase due to the prong 76 as the blades touch the underside of the tubing which strokes the tool.
5. Pick up a set amount to give some travel for cutting.
6. Keep going until you see lower pressure again which means that you are near the end of the stroke.
7. Pick up again and repeat as required until you have the milled length of section which you need.

In an embodiment, the string 20 is raised at the same time as the device 14 is stroked. In this way you can balance the operation and attempt to keep the device 14 in mid-stoke so that neither the first 84 or second 86 signal is detected. This is as illustrated in FIG. 1D. This provides continuous milling over any section 22 of tubing to be cut in a single trip in the well without retracting the blades 80 at any time.

While the indicator 30 provides first 84 and second 86 signals in the form of a pressure drop recordable at surface, it will be appreciated that the parts could be arranged to provide a pressure increase at surface instead or one of each depending on which end of the stroke you are at. Additionally while a prong used to form restrictions in the central bore is used to provide the indicator 30, electronic switches could be used which would provide a signal to be relayed by known telemetry techniques to surface.

The apparatus 10 and method find particular use in a rigless method for well abandonment as described in WO 2016/156862 to the present applications. The steps in this well abandonment procedure are illustrated in FIGS. 4A-G.

Figures 4A, 4B, 4C, 4D, 4E, 4F, 4G:
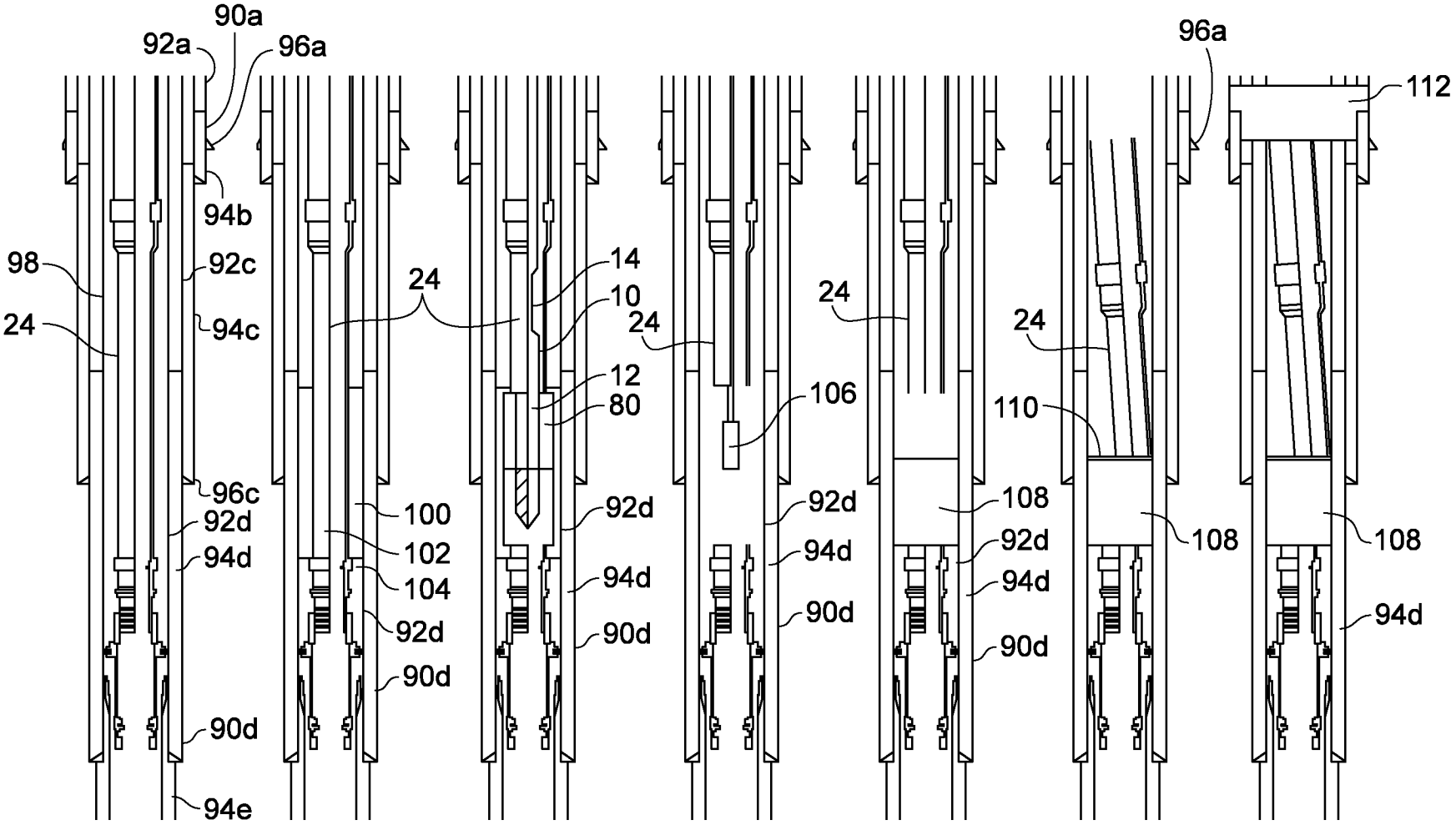
FIGS. 4A to 4G are views of a well bore illustrating steps in a method of abandoning a well using an apparatus and method according to an embodiment of the present invention.

FIG. 4A shows a typical well with five strings of casing and tubing installed. The initial section of wellbore 90*a* was drilled to a certain depth, after which casing 92*a* was run into the well. Cement 94*a* was set over a portion of the outside of the casing 92*a*, sealing the annulus between the casing 92*a* and the wellbore 90*a*. The next section of wellbore 90*b* was then drilled to the target depth of the well. A next section of casing 92*b* was run into the well, suspended inside the first casing 92*a* with a hanger 96*a* and likewise cemented 94*b* to seal the annulus between the second casing 92*b* and the wellbore 90*b*. This is repeated until the well reaches the desired depth. A liner 98 can then be tied back to surface. An inner tubular 24 which is the production tubing is then run in to complete the well as is known in the art. When the time comes to abandon the well, the typical approach is to remove the production tubing 24 using a rig. A cement bond log (CBL) can then be made over a length of the well in which there is a cement sheath 94*d* between the respective casing 92*d* and the wellbore 90*d*. If the bond is good then a cement plug can be placed inside the casing 92*d*. However, if the bond does not have the required integrity the casing 92*d* is milled out usually downwards from the hanger 96*c*. The cement sheath 94*d* is reamed away and then a cement plug formed across the entire wellbore 90*d*. As detailed this approach requires a rig from which the production tubing can be pulled.

An alternative approach which can be used in a rigless arrangement i.e. from a floating vessel which does not require the expense of a rig, is described in WO 2016/156862. In FIG. 4B, it is seen that the production tubing 24 is left in place. The tubing 24 is perforated and a gel or other settable material 100 squeezed through the perforations 102 to fill an annulus 104 between the tubing 24 and the casing 92*d*. The material 100 advantageously holds the production tubing 24 in place so that it can be milled.

FIG. 4C shows the apparatus 10 of the present invention being used to upwardly mill the production tubing 24 while leaving the casing 92*d* intact. Any length of the tubing can be removed and ideally a length sufficient to form a cement plug to legislative requirements would be selected. With the production tubing 24 milled away, the casing 92*d* is now exposed and a cement bond log can now be performed over the section 22 using a CBL tool 106 as is known in the art. This is shown in FIG. 4D. If the CBL is satisfactory, a cement plug 108 is formed in the wellbore 90*d* as illustrated in FIG. 4F.

If desired the procedure can include the steps of spotting sand 110 on top of the cement plug 108 acting as the primary barrier. The production tubing 24 can be cut together with the control lines so as to free the completion below the uppermost hanger 96*a*. This is illustrated in FIG. 4F. The hanger seals can then be pulled and recovered before a secondary barrier in the form of a further cement plug 112 is put in place as shown in FIG. 4G to finish abandonment of the well.

The principal advantage of the present invention is that it provides a method for removing a section of well tubing in rigless arrangement were milling is near continuous.

A further advantage of an embodiment of the present invention is that it provides a method for removing a section of well tubing on a single trip in a well.

A still further advantage of an embodiment of the present invention is that it provides apparatus that indicates when a hydraulic tensioning device is towards an end of a stroke so that adjustments can be made to maintain a constant load on a continuously rotating section mill.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example, while the section mill is described for upward movement to mill the tubular, the section mill could be adapted to operate in a downward fashion also.

We claim:

1. A method for removing a section of well tubing comprising the steps:

a) providing a work string with a hydraulic tensioning device and a section mill mounted below the hydraulic tensioning device;

b) lowering the work string into tubing to be milled;

c) pumping fluid through the work string to actuate the section mill and extend cutter blades;

d) rotating the section mill to mill the tubing with the cutter blades;

e) pumping fluid through the work string to actuate the hydraulic tensioning device to hydraulically pull a lower end of the hydraulic tensioning device upwards towards the work string thereby pulling the section mill upwards while milling the tubing;

f) raising the work string to extend the hydraulic tensioning device while milling the tubing;

g) repeating steps (e) and (f) to remove a longitudinal section of the tubing; and wherein step (f) is performed before the hydraulic tensioning device bottoms out.

2. A method for removing a section of well tubing according to claim 1 wherein steps (d) through (a) are performed as a continuous operation without stopping the mill.

3. A method for removing a section of well tubing according to claim 1 wherein the method includes cycling through steps (e) to (f) repeatedly until a desired length of tubing has been removed.

4. A method for removing a section of well tubing according claim 1 wherein the method includes performing steps (e) and (f) together.

5. A method for removing a section of well tubing according to claim 1 wherein a first signal is provided when the hydraulic tensioning device is near the end of its stroke.

6. A method for removing a section of well tubing according to claim 5 wherein the first signal is a pressure change in the fluid at surface.

7. A method for removing a section of well tubing according to claim 5 wherein a second signal is provided when the hydraulic tensioning device is fully extended.

8. A method for removing a section of well tubing according to claim 7 wherein the second signal is a pressure change in the fluid at surface.

9. A method for removing a section of well tubing according to claim 1 wherein the work string is lowered from a floating vessel.

10. A method for removing a section of well tubing according to claim 1 wherein the method includes the step of rotating the work string to rotate the section mill.

11. A method for removing a section of well tubing according to claim 1 wherein the method includes the step of actuating a downhole motor to rotate the section mill.

12. A method for removing a section of well tubing according to claim 1 wherein the method includes the step of cutting through the tubing prior to milling the tubing.

13. A method for removing a section of well tubing according to claim 1 wherein the tubing is cut and milled on a single trip into the well.

14. A method for removing a section of well tubing according to claim 1 wherein the method includes the step of disposing of cuttings downhole.

15. A method for removing a section of well tubing according to claim 1 wherein the method includes the further step of conducting a cement bond log (CBL) over the length of well in which the section of well tubing has been removed.

16. Apparatus for removing a section of well tubing comprising:

a work string;

a hydraulic tensioning device having an upper end and a lower end, the upper end being attachable to the work string, the hydraulic tensioning device being adapted to stroke and selectively pull the lower end upwardly towards the work string;

a section mill attachable to a lower end of the hydraulic tensioning device, the section mill including a plurality of blades, the blades being arranged to move from a first position within the section mill to a second position being extended to contact the well tubing and thereby mill the tubing in an upward direction;

characterised in that:

the hydraulic tensioning device includes at least one indicator, the at least one indicator providing a first signal and a second signal when the hydraulic tensioning device is towards each end of its stroke, respectively.

17. Apparatus for removing a section of well tubing according to claim 16 wherein the indicator comprises a variable fluid flow restrictor.

18. Apparatus for removing a section of well tubing according to claim 16 wherein the indicator comprises an electronic switch which detects the position of relative parts of the hydraulic tensioning device.

* * * * *